US006138571A

United States Patent [19]

Denney

[11] Patent Number: 6,138,571

[45] Date of Patent: Oct. 31, 2000

[54] FIRESET FOR A LOW ENERGY EXPLODING FOIL INITIATOR: MOSFET DRIVEN MOSFET SWITCH

[75] Inventor: Jim R. Denney, Ridgecrest, Calif.

[73] Assignee: The United States of America as represented by the Secretary of the Navy, Washington, D.C.

[21] Appl. No.: 09/226,629

[22] Filed: Dec. 21, 1998

[51] Int. Cl.[7] ..... F24D 1/45

[52] U.S. Cl. ..... 102/206; 102/218; 102/220; 102/215

[58] Field of Search ..... 102/220, 216, 102/215, 206

[56] References Cited

U.S. PATENT DOCUMENTS

| | | | |
|---|---|---|---|
| 3,750,586 | 8/1973 | Swallow et al. | 102/16 |
| 4,012,671 | 3/1977 | Vaice | 361/249 |
| 4,041,865 | 8/1977 | Evans et al. | 102/20 |
| 4,227,462 | 10/1980 | Tucker | 102/220 |
| 5,173,570 | 12/1992 | Braun | 102/347 |
| 5,218,574 | 6/1993 | Peregrim | 367/136 |
| 5,507,230 | 4/1996 | Lewis et al. | 102/218 |
| 5,886,287 | 3/1999 | Will et al. | 102/220 |

*Primary Examiner*—Charles T. Jordan
*Assistant Examiner*—Lulit Semunegus
*Attorney, Agent, or Firm*—Earl H. Baugher, Jr.; Gregory M. Bokar

[57] ABSTRACT

A fireset for a low energy exploding foil initiator (LEEFI) comprises a first capacitor for storing a level of electrical energy sufficient to fire the LEEFI, the first capacitor being in electrical communication with the LEEFI, second, third, and fourth capacitors in electrical communication with the first capacitor for storing lesser levels of energy than the first capacitor. A trigger directs a pulse of electrical energy into the fireset. An integrated circuit to which the pulse of electrical energy is directed, is adapted to invert the pulse and to dump the third and fourth capacitors. A first metal oxide semi-conductor fill effect transistor (MOSFET) switch is turned on by the integrated circuit and the dumping of the third and fourth capacitors, the first MOSFET switch being operable to dump the second capacitor. A second MOSFET through, which the second capacitor is dumped, operates to discharge the first capacitor through the second MOSFET, to fire the LEEFI.

15 Claims, 1 Drawing Sheet

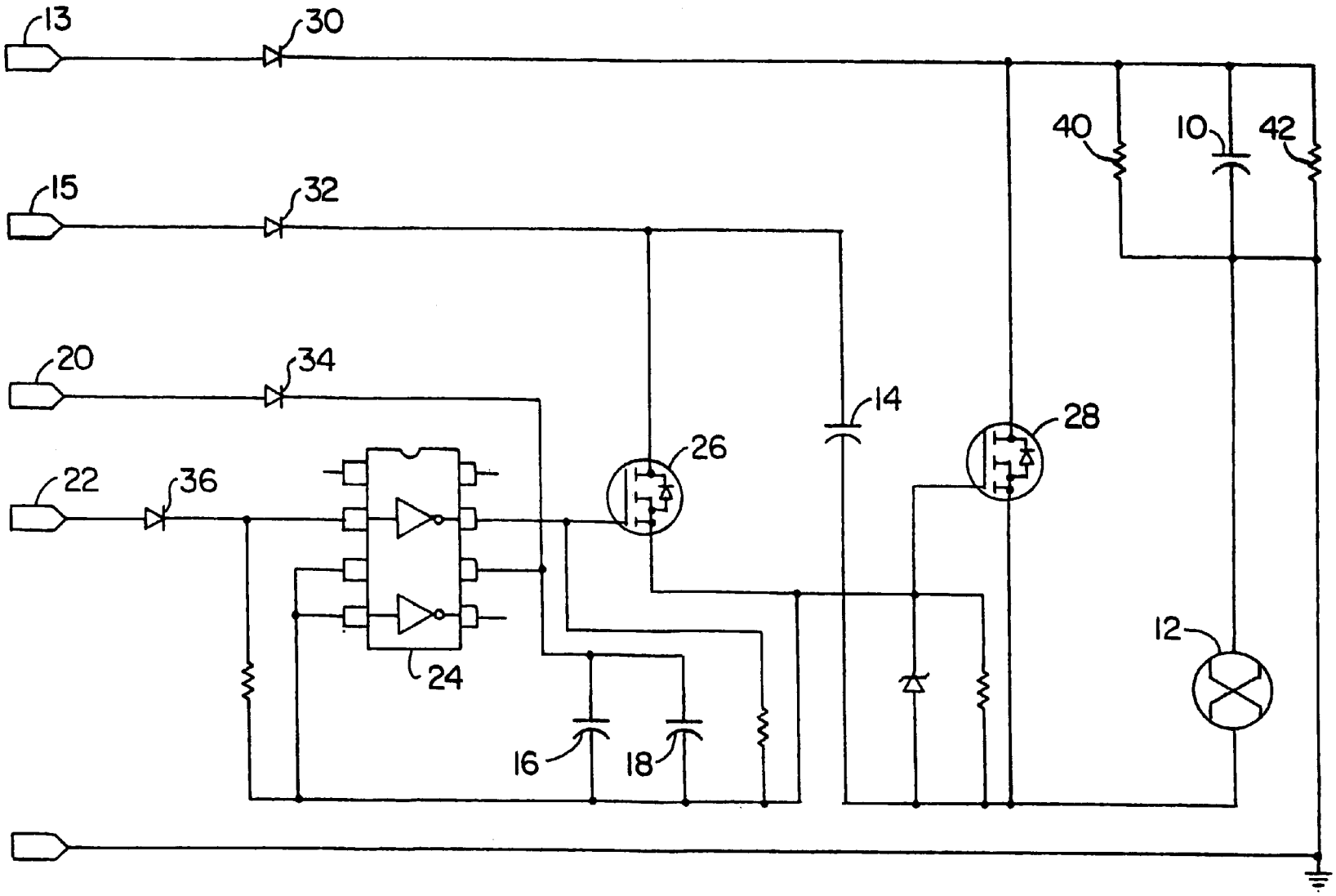
42
10
40
28
14
26
12
18
16
24
30
32
34
36
13
15
20
22

FIRESET FOR A LOW ENERGY EXPLODING FOIL INITIATOR: MOSFET DRIVEN MOSFET SWITCH

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The invention relates to exploding foil initiator systems for munitions and is directed more particularly to a low energy exploding foil initiator (LEEFI) system.

2. Description of the Prior Art

Exploding foil initiators (EFIs) are activated by a high current pulse exhibiting an extremely short rise time. The pulse is generated by discharging a high voltage capacitor through a spark gap switch. Spark gap switches have suffered from problems relative to manufacturing, reliability in operation, and high costs. A new LEEFI has been developed which operates at substantially lower energy levels than conventional EFIs. The new LEEFI has the potential to reduce size and cost of foil initiator systems by reducing the size of the high voltage capacitor and charging circuitry.

Spark gap switches are deemed to be less than optimal for LEEFI fireset designs. The reliability of the spark gap switches is reduced at voltages of less than 1500V and therefore do not allow for full advantage of savings that could be derived from LEEFI operations which require 1000 V, or less. Further, spark gap switches are reliable only for a limited number of discharges. Accordingly, during and after manufacture, the number of tests performed on each switch must be tracked to ensure that overtest does not degrade performance in a weapon.

Accordingly, there is a need for a new switch, or fireset, for LEEFIs.

SUMMARY OF THE INVENTION

It is, therefore, an object of the invention to provide a fireset for use in conjunction with a LEEFI.

With the above and other objects in view, as will hereinafter appear, a feature of the present invention is the provision of a fireset for a LEEFI, the fireset comprising a first capacitor for storing a level of electrical energy sufficient to fire the LEEFI, the first capacitor being in electrical communication with the LEEFI, second, third and fourth capacitors in electrical communication with the first capacitor for storing lesser levels of energy than the first capacitor. A trigger directs a pulse of electrical energy into the fireset and to an integrated circuit therein which is adapted to invert the pulse and to dump the third and four capacitors. A first metal oxide semi-conductor fill effect transistor (MOSFET) switch is turned on by the integrated circuit and by the dumping of the third and fourth capacitors, the first MOSFET switch being operable to dump the second capacitor. A second MOSFET, through which the second capacitor is dumped, is operative to discharge the first capacitor through the second MOSFET to fire the LEEFI.

The above and other features of the invention, including various novel details of construction and combinations of parts, will now be more particularly described with reference to the accompanying drawings and pointed out in the claims.

It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawing in which is shown an illustrative embodiment of the invention, from which its novel features and advantages will be apparent, and wherein:

The drawing is a schematic diagram of a fireset in combination with a LEEFI, illustrative of an embodiment of the invention.

DESCRIPTION OF THE PREFERRED EMBODIMENT

Referring to FIG. 1, it will be seen that a fireset illustrative of an embodiment of the invention includes a first capacitor 10 for storing a level of electrical energy sufficient to fire an LEEFI 12 which is in electrical communication with the first capacitor 10. The first capacitor 10 is a 0.2 uf low impedance capacitor charged to 1000 V from a 1000 V DC source 13.

In circuit with the first capacitor 10 are second, third and fourth capacitors 14, 16, 18. The second capacitor 14 is charged to 75V from a 75 V DC source 15 and the third and fourth capacitors are each charged to 15 V from a 15 V DC source 20.

In circuit with the aforementioned capacitors 10, 14, 16 and 18 is a trigger 22 for directing a pulse of electrical energy into the fireset. The pulse of electrical energy is directed to an integrated circuit 24 which inverts the pulse and acts to dump the third and fourth capacitors. The integrated circuit 24 is a high speed driver with a 15 nsec. rise time into a 1000 picoFarad load.

The fireset further includes a first MOSFET switch 26 turned on by the integrated circuit and the dumping of the third and fourth capacitors 16, 18 and which rapidly dumps the second capacitor 14 through the gate of a second MOSFET 28, driving the second MOSFET 28 into avalanche mode and discharging the first capacitor 10 through the second MOSFET and the LEEFI 12. Thus, the integrated circuit 24 triggers the switching MOSFET 26 to drive the second MOSFET 28 into the avalanche operating mode.

Diode rectifiers 30, 32, 34 and 36 isolate the power supplies 13, 15, 20, and the trigger 22, respectively, permitting the MOSFET switch 26 and its drive circuit, i.e., the third and fourth capacitors 16, 18 and the output of the integrated circuit 24, to float high when the trigger pulse is received. Only the low side of the first capacitor 10, and its bleed-off resistors 40, 42, are tied to ground. Several trigger circuits (not shown) can be operated in isolation from each other to provide a multipoint initiation system.

There is thus provided a fireset for LEEFIs which is reliable in operation, relatively easy and inexpensive to manufacture, and which can be used with a 1000 V source, rather than the customary 1500 V source required for spark gap switches. Further, tests have shown no appreciable degradation of the fireset after hundreds of firings.

It will be understood that many changes in the details, materials and arrangement of parts, which have been herein described and illustrated in order to explain the nature of the invention, may be made by those skilled in the art within the principles and scope of the invention as expressed in the appended claims.

What is claimed is:

1. A fireset for a low energy exploding foil initiator (LEEFI), the fireset comprising:

a first capacitor for storing a level of electrical energy sufficient to fire the LEEFI, said first capacitor being in electrical communication with said LEEFI;

second, third, and fourth capacitors in electrical communication with said first capacitor for storing lesser levels of energy than said first capacitor;

trigger means for directing a pulse of electrical energy into said fireset;

an integrated circuit to which said pulse of electrical energy is directed and which is adapted to invert said pulse and to dump said third and fourth capacitors;

a first metal oxide semi-conductor fill effect transistor (MOSFET) switch turned on by said integrated circuit and the dumping of said third and fourth capacitors, said first MOSFET switch being operable to dump said second capacitor; and a second MOSFET through which said second capacitor is dumped, operative to discharge said first capacitor through said second MOSFET, to fire the LEEFI.

2. The fireset in accordance with claim 1 wherein said first capacitor energy storage capacity is about 1000 V.

3. The fireset in accordance with claim 2 wherein said second capacitor is charged to about 75 V.

4. The fireset in accordance with claim 3 wherein said third and fourth capacitors are each charged to about 15 V.

5. The fireset in accordance with claim 1 wherein said integrated circuit comprises a high speed driver with a 15 nsec rise time into a 1000 picoFarad load.

6. The fireset in accordance with claim 5 wherein said integrated circuit is operable to invert the pulse directed to said integrated circuit by said trigger means.

7. The fireset in accordance with claim 1 wherein upon activation of said trigger said MOSFET switch drives said second MOSFET into an avalanche operating mode, causing said discharge of said first capacitor to effect said firing of the LEEFI.

8. The fireset in accordance with claim 1 and further comprising a first DC power source of about 1000 V in electrical communication with said first capacitor, and a first diode rectifier disposed in circuit between said first power source and said first capacitor.

9. The fireset in accordance with claim 8 and further comprising a second DC power source of about 75 V in electrical communication with said second capacitor, and a second diode rectifier disposed in circuit between said second power source and said second capacitor.

10. The fireset in accordance with claim 9 and further comprising a third DC power source of about 15 V in electrical communication with said third and fourth capacitors, and a third diode rectifier disposed in circuit between said third power source and said third and fourth capacitors.

11. The fireset in accordance with claim 10 and further comprising a fourth diode rectifier disposed in circuit between said trigger means and said integrated circuit.

12. The fireset in accordance with claim 1 and further comprising power sources for said capacitors, and a diode rectifier in circuit between each of said capacitors and the power source therefor, and a diode rectifier in circuit between said trigger means and said integrated circuit.

13. The fireset in accordance with claim 1 and further comprising bleed-off resistor means in electrical communication with said first capacitor, said resistor means being tied to ground.

14. The fireset in accordance with claim 12 and further comprising bleed-off resistor means in electrical communication with said first capacitor, said resistor means being tied to ground, whereby said MOSFET switch, said third and fourth capacitors, and the output from said integrated circuit are operative to float high when the pulse from said trigger means is received.

15. The fireset in accordance with claim 1 wherein said trigger means comprises a plurality of triggers operable independently of each other.

* * * * *